US011117279B2

(12) United States Patent
Georgakis et al.

(10) Patent No.: US 11,117,279 B2
(45) Date of Patent: Sep. 14, 2021

(54) RAZOR HANDLE

(71) Applicant: Bic Violex S.A., Anixi (GR)

(72) Inventors: Georgios Georgakis, Athens (GR); Nikolaos Ovvadias, Athens (GR); Ioannis Marios Psimadas, Athens (GR)

(73) Assignee: BIC VIOLEX S.A., Anoixi (GR)

( * ) Notice: Subject to any disclaimer, the term of this patent is extended or adjusted under 35 U.S.C. 154(b) by 7 days.

(21) Appl. No.: 16/610,770

(22) PCT Filed: May 4, 2018

(86) PCT No.: PCT/EP2018/061496
§ 371 (c)(1),
(2) Date: Nov. 4, 2019

(87) PCT Pub. No.: WO2018/202848
PCT Pub. Date: Nov. 8, 2018

(65) Prior Publication Data

US 2020/0156274 A1 May 21, 2020

(30) Foreign Application Priority Data

May 5, 2017 (EP) ..... 17169741

(51) Int. Cl.
*B26B 21/52* (2006.01)
*B26B 21/22* (2006.01)

(52) U.S. Cl.
CPC ..... *B26B 21/521* (2013.01); *B26B 21/225* (2013.01); *B26B 21/522* (2013.01)

(58) Field of Classification Search
CPC ..... B26B 21/521; B26B 21/52; B26B 21/522; B26B 21/225; B26B 21/528;
(Continued)

(56) References Cited

U.S. PATENT DOCUMENTS 1,848,078 A * 3/1932 Jansson ..... B26B 21/30 30/51
2,033,307 A 3/1936 Schuster
(Continued)

FOREIGN PATENT DOCUMENTS

CN 102271876 A 12/2011
GB 440382 A 12/1935
(Continued)

OTHER PUBLICATIONS

International Search Report issued in related International Application No. PCT/EP2018/061496 dated Aug. 10, 2018 (3 pages).
(Continued)

*Primary Examiner* — Ghassem Alie
(74) *Attorney, Agent, or Firm* — Bookoff McAndrews, PLLC

(57) ABSTRACT

A razor handle and a method for releasing an exchangeable razor blade cartridge from the razor handle. The razor handle including a connector for connecting the exchangeable razor blade cartridge to the razor handle, a release mechanism for releasing the exchangeable razor blade cartridge from the razor handle, and a release trigger. The release trigger is rotatable around a longitudinal axis of the razor handle relative to the connector to actuate the release mechanism.

19 Claims, 6 Drawing Sheets

(58) Field of Classification Search
CPC ..... B26B 21/4093; B26B 21/227; B26B 21/4037; B26B 21/40
USPC ... 30/527, 85, 47, 89, 40.1, 50, 87, 86, 338, 30/528, 832, 533, 51, 60, 529, 34.2, 531; 15/104.94, 145, 146, 171, 176.1, 177, 172
See application file for complete search history.

(56) References Cited

U.S. PATENT DOCUMENTS

| | | | | | |
|---|---|---|---|---|---|
| 2,143,276 | A * | 1/1939 | Martin | B26B 21/18 | 30/60.5 |
| 2,582,041 | A * | 1/1952 | Kaplan | B26B 21/32 | 30/59 |
| 3,435,521 | A * | 4/1969 | Kuhnl | B26B 21/32 | 30/60.5 |
| 4,253,235 | A * | 3/1981 | Jacobson | B26B 21/521 | 30/47 |
| 4,797,998 | A * | 1/1989 | Motta | B26B 21/225 | 30/530 |
| 4,922,609 | A * | 5/1990 | Grange | B26B 21/521 | 30/57 |
| 4,987,634 | A | 1/1991 | Weihrauch | | |
| 5,600,887 | A * | 2/1997 | Olson | B26B 21/225 | 30/41.5 |
| 5,953,824 | A * | 9/1999 | Ferraro | B26B 21/225 | 30/527 |
| 2005/0066465 | A1 | 3/2005 | Minkler et al. | | |
| 2009/0159487 | A1 | 6/2009 | Tacoma | | |
| 2013/0047449 | A1 | 2/2013 | Zakuskin | | |
| 2017/0113363 | A1 | 4/2017 | Lopez | | |

FOREIGN PATENT DOCUMENTS

| | | | |
|---|---|---|---|
| GB | 2078589 | A | 1/1982 |
| GB | 2362849 | A | 12/2001 |
| WO | WO 2010/037418 | A1 | 4/2010 |
| WO | WO 2015/158382 | A1 | 10/2015 |
| WO | WO 2016/087007 | A1 | 6/2016 |

OTHER PUBLICATIONS

Office Action issued in Chinese Patent Application No. 201880025326.6, dated Dec. 29, 2020 (5 pages).
Search Report issued in Chinese Patent Application No. 201880025326.6, dated Dec. 19, 2020 (2 pages).

* cited by examiner

RAZOR HANDLE

CROSS REFERENCE TO RELATED APPLICATIONS

This application is a National Stage application of International Application No. PCT/EP2018/061496, filed on May 4, 2018, now published as WO/2018/202848 and which claims priority to European Application No. 17169741.0, filed May 5, 2017.

FIELD

The present disclosure relates to razors, and more specifically to razors of the type comprising a razor handle and an exchangeable razor blade cartridge. The razors, which may be specifically adapted for shaving facial, head and/or body hair, may allow for replacement of the exchangeable razor blade cartridge. Replacement of the exchangeable razor blade cartridge may occur particularly when a razor blade or blades of the razor blade cartridge have been blunted and may be facilitated without discarding the razor handle.

BACKGROUND

Razors comprising a razor handle and an exchangeable razor blade cartridge are commonly known in the art. In such razors, the razor handle may comprise an elongated body extending in a longitudinal direction from a front end to a rear end, a connector for connecting an exchangeable razor blade cartridge to the razor handle, and a release mechanism for releasing the exchangeable razor blade cartridge from the razor handle, and a release trigger, located at the front end of the razor handle, in close proximity to the release mechanism and connector, to trigger the release of the exchangeable razor blade cartridge from the connector.

A drawback of this configuration is that, because the release trigger is located near the front end of the razor handle, release of the exchangeable razor cartridge may be inadvertently triggered by a user moving his grip closer to the front end of the razor handle when trying to achieve a more precise shave.

SUMMARY

A first aspect of the disclosure concerns providing a more convenient and safer razor handle and in particular a razor handle having an elongated body, a connector for connecting an exchangeable razor blade cartridge to the razor handle, a release mechanism for releasing the exchangeable razor blade cartridge from the razor handle, and a release trigger, wherein the risk of inadvertent release of an exchangeable razor blade cartridge may be decreased.

Accordingly, in at least one aspect, the release trigger may be rotatable around a longitudinal axis of the razor handle relative to the connector to actuate the release mechanism.

The release trigger may comprise a rear part of the razor handle and the connector may be located at a front end of the razor handle. By allowing the rear part of the razor handle to comprise the release trigger and by locating the connector at the front end of the razor handle, inadvertent operation of the release trigger may be prevented when the user holds the razor handle close to the connector. Thus, positioning the release trigger apart from the connector, may decrease the overall risk of inadvertent operation of the release mechanism.

The razor handle may further comprise a cam mechanism for converting a rotation of the release trigger about the longitudinal axis, relative to the connector, into a motion along the longitudinal axis to actuate the release mechanism. Operation of the release trigger may be facilitated by this cam mechanism. In particular, the cam mechanism may comprise first and second cam surfaces that may be inclined in opposite directions. Inclining the cam surfaces in opposing directions facilitates the conversion of opposite rotational movements of the release trigger into longitudinal movement in the same direction for actuation of the release mechanism. Consequently, release of the exchangeable razor blade cartridge may be triggered by turning the release trigger in either direction about the longitudinal axis, relative to the connector, from a central starting position. However, the conversion of a rotation of the release trigger around the longitudinal axis into a motion along the longitudinal axis may also be carried out by other means than a cam mechanism, such as, for example, magnetic mechanism.

The razor handle may be simply and reliably connected to the exchangeable razor blade cartridge by a snap-fit connection in which a latching surface of the exchangeable blade cartridge engages an opposite surface of the connector to retain the exchangeable razor blade cartridge relative to the connector. The release mechanism may be configured to deflect the latching surface of the exchangeable blade cartridge out of engagement with the connector, so as to release the snap-fit connection between the razor handle and the exchangeable razor blade cartridge.

The razor handle may further comprise a spring-loaded pusher for urging a pivotable head of the exchangeable razor blade cartridge in one pivoting direction. The spring-loaded pusher may provide for closer contact and better alignment of the razor blades with the skin during shaving. The release mechanism may then be formed as a fork-shaped ejector comprising two front prongs, and the spring-loaded pusher be located between the two front prongs. This structure may allow for a more compact arrangement. Alternatively, however, the release mechanism may be analogous to those disclosed in international patent application publications WO 2016/087007, WO2015/158382 and WO2010/037418.

A second aspect of the disclosure concerns a razor comprising a razor handle and an exchangeable razor blade cartridge connected by the connector to the razor handle.

The exchangeable razor blade cartridge may comprise an interconnecting member configured to engage the connector, and a pivotable head. The interconnecting member may facilitate engagement of the exchangeable razor blade cartridge with the connector. The pivotable head may comprise at least one razor blade and may be supported so as to be pivotable around at least one transverse axis with respect to the interconnecting member. The exchangeable razor blade cartridge and pivotable head may provide for a closer contact and better alignment of the razor blades with the skin during shaving. The exchangeable razor blade cartridge may be snap-fitted to the connector. The snap-fit connection may ensure a reliable and simple connection of the razor handle to the exchangeable razor blade cartridge. The pivotable head may provide closer contact and better alignment of the razor blades with the skin during shaving.

A third aspect concerns a method for releasing an exchangeable razor blade cartridge from a razor handle. This method may comprise a step of rotating a release trigger about a longitudinal axis of the razor handle, relative to a connector which connects the exchangeable razor blade cartridge to the razor handle, to actuate a release mechanism so as to release the exchangeable razor blade cartridge from the connector.

The above summary is not intended to describe each aspect or every implementation of the disclosed concept. In particular, selected features of illustrative embodiments within this disclosure may easily be incorporated into additional embodiments unless clearly stated to the contrary.

BRIEF DESCRIPTION OF THE DRAWINGS

The disclosure may be more completely understood in consideration of the following detailed description of various aspects of the disclosure in connection with the accompanying drawings, in which.

Figure 1:
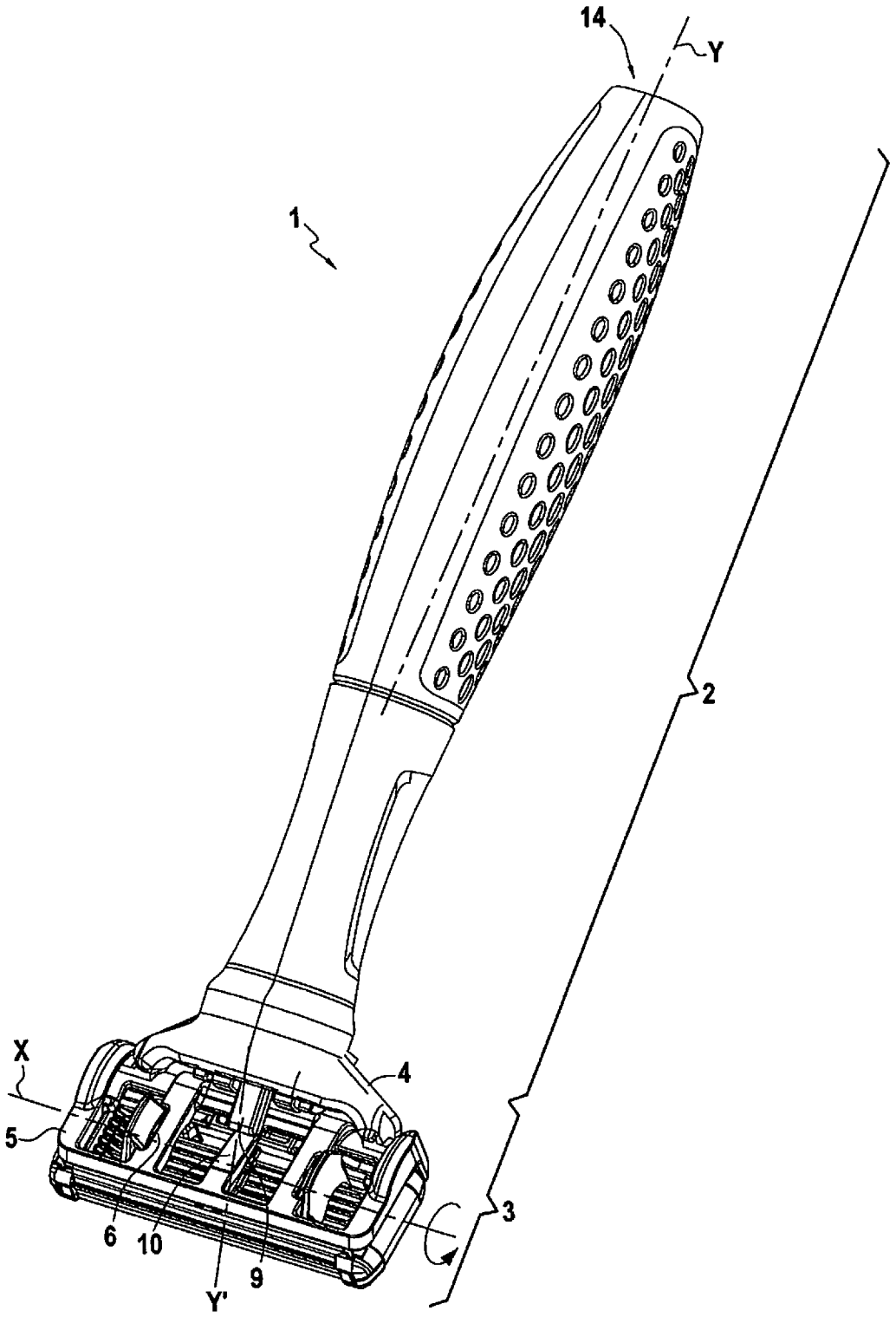
FIG. 1 is a first perspective view of a razor according to an aspect of the disclosure.
Figure 2:
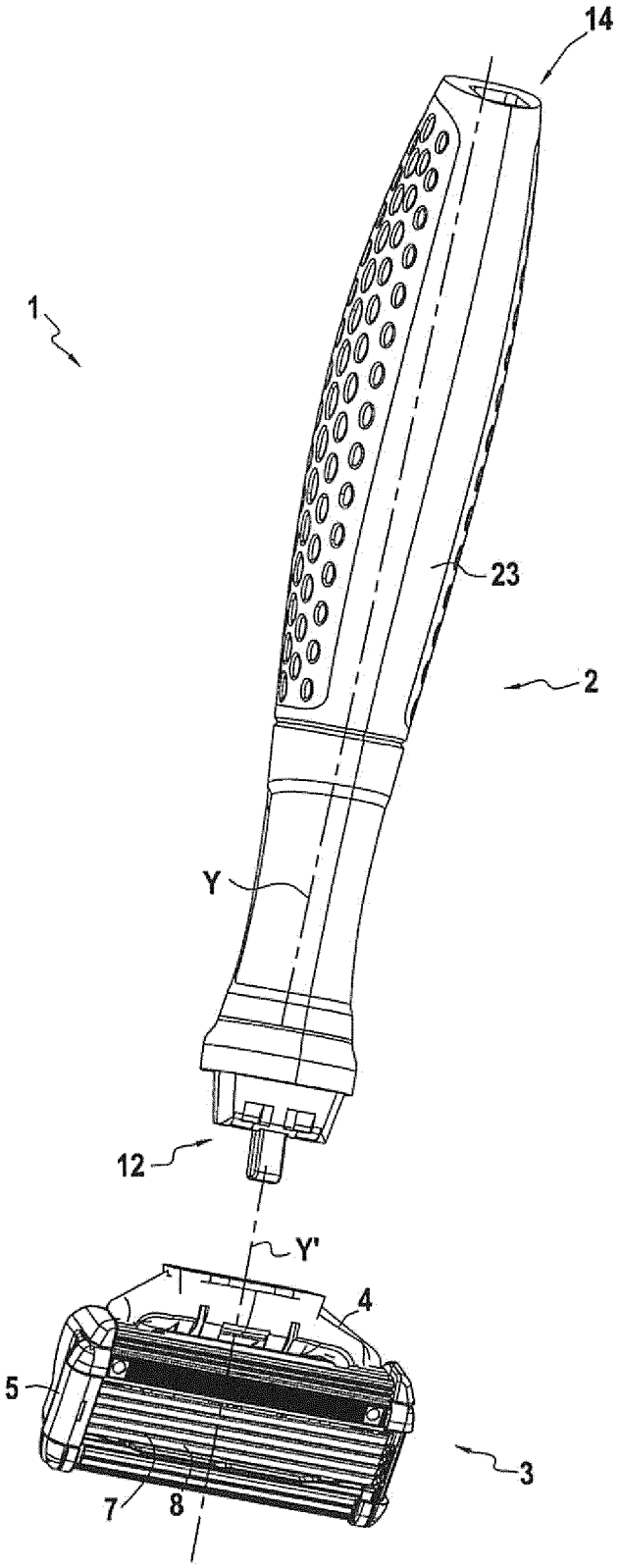
FIG. 2 is a second perspective view of the razor of FIG. 1.

While the disclosure is amenable to various modifications and alternative forms, specifics thereof have been shown by way of example in the drawings and will be described in detail. It should be understood, however, that the intention is not to limit aspects of the disclosure to the particular embodiments described. On the contrary, the intention is to cover all modifications, equivalents, and alternatives falling within the scope of the disclosure.

DETAILED DESCRIPTION

As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

The following detailed description should be read with reference to the drawings. The detailed description and the drawings, which are not necessarily to scale, depict illustrative aspects of the disclosure and are not intended to limit the scope. The illustrative aspects depicted are intended only as exemplary.

A razor 1 according to an aspect is shown in FIGS. 1 to 4. This razor 1 may be a wet-shave razor. The razor 1 may comprise a razor handle 2 and an exchangeable razor blade cartridge 3. The exchangeable razor blade cartridge 3 may comprise an interconnecting member 4 and a pivotable head 5 connected to the interconnecting member 4. As provided in further detail below, the interconnecting member 4 is configured to facilitate connection of the exchangeable razor blade cartridge 3 with the razor handle 2. The interconnecting member 4 may comprise arcuate tracks 6 configured to support razor blades 8. The pivotable head 5 may be a multi-blade head, for example, a five-blade head. Alternatively, however, it may comprise one single razor blade. The pivotable head 5 may be supported by the arcuate tracks 6 of the interconnecting member 4 so as to be pivotable, relative to the interconnecting member 4, about at least one transverse axis X which is substantially parallel to the cutting edges 7 of razor blades 8 mounted on the pivotable head 5.

According to further aspects, the razor handle 2 may be elongated and extend along longitudinal axis Y from a front end 12 to a rear end 14. As shown on FIG. 3, the razor handle 2 may comprise a connector 11, located at the front end 12 of the razor handle 2, a central body 13 and a rear part 23. The razor handle 2 may comprise a spring-loaded pusher 9. The spring-loaded pusher 9 may protrude from the front end 12 of the razor handle 2 and through the interconnecting member 4 to push against a contact surface 10 of the pivotable head 5. The spring-loaded pusher 9 may push against the contact surface 10 along a pushing axis Y', orthogonal and offset with respect to the transverse axis X, so as to urge the pivotable head 5 in a pivoting direction about transverse axis X thereby maintaining close contact and optimal alignment of the razor blades with respect to the skin during shaving. Although in the illustrated razor 1 the pivotable head 5 is pivotable only around one axis, according to further aspects it may be pivotable around more than one axis. The pivotable head 5 may further comprise a lubricant strip 50 and/or a finned guard bar 51 disposed adjacent to the cutting edges 7 of the razor blades 8. The lubricant strip 50 and/or finned guard bar 51 may be configured to further improve the shaving feel. According to further aspects, the razor blades 8 may be resiliently supported on the pivotable head 5 by being mounted for example on blade springs 52 for a closer shave. Alternatively, however, the razor blades 8 could be directly fixed onto the pivotable head 5, without any such blade springs.

Figures 3, 4:
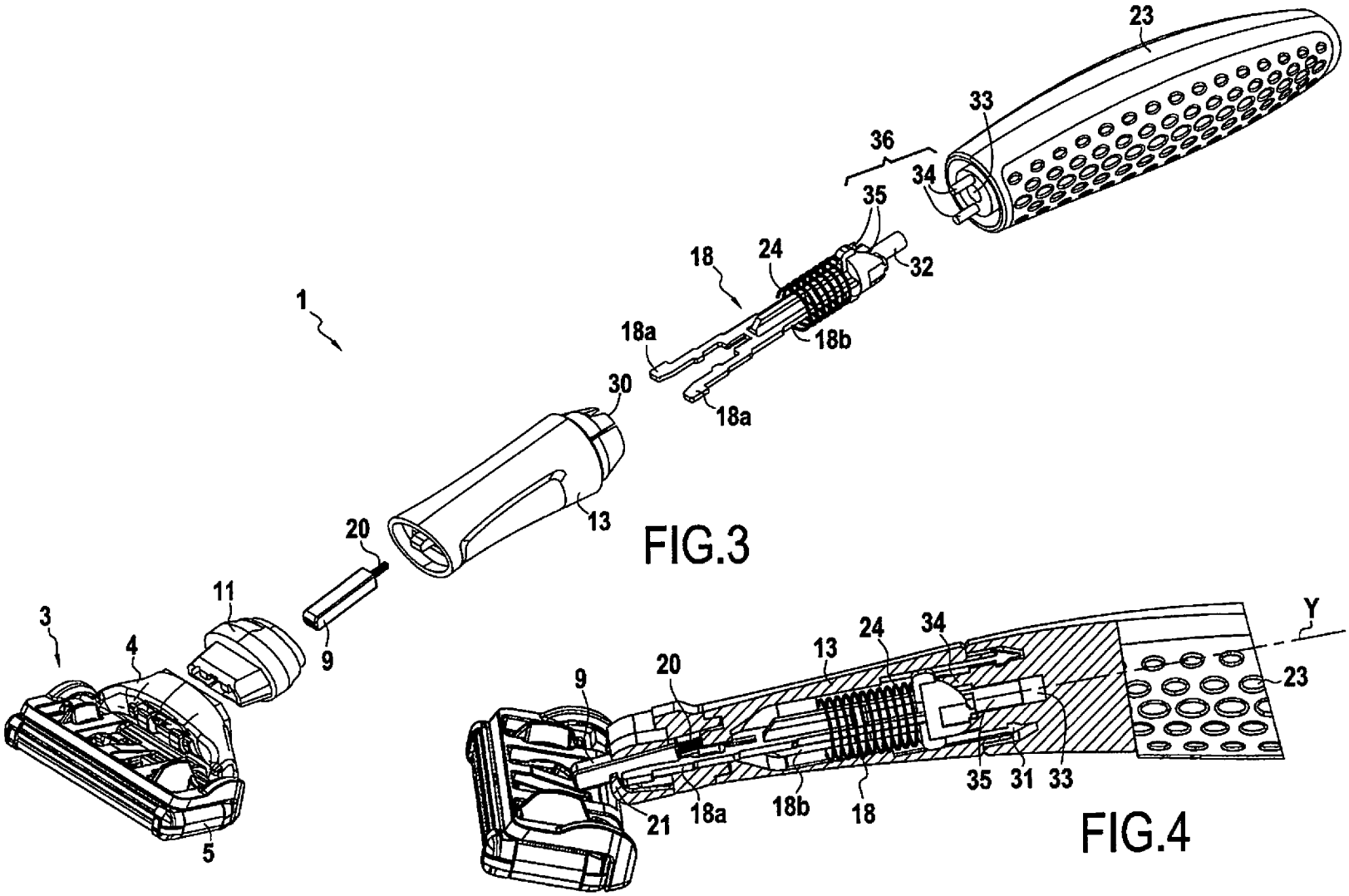
FIG. 3 is a perspective exploded view of the razor of FIG. 1.
FIG. 4 is a longitudinal cut view of the razor of FIG. 1 along plane IV-IV.

As shown in FIG. 3, the rear part 23 of the razor handle 2 may be configured to function as a release trigger. The central body 13 may be fixed to connector 11, whereas the rear part 23 may be twistable about the longitudinal axis Y relative to the central body 13 and connector 11 while remaining axially attached to both the connector 19 and central body 13. According to further aspects, the central body 13 may comprise latching elements 30 disposed at a rear thereof. The latching elements 30 facilitate latching of the central body 13, about the longitudinal axis Y, onto an undercut circular track 31 formed in the rear part or release trigger 23, as shown in FIG. 4.

Figure 5:
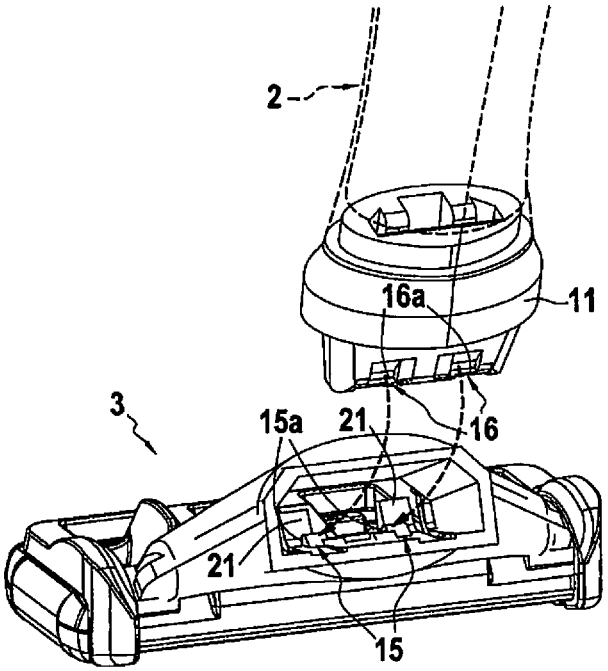
FIG. 5 illustrates the snap-fit connection of the razor handle and exchangeable razor blade.
Figure 6:
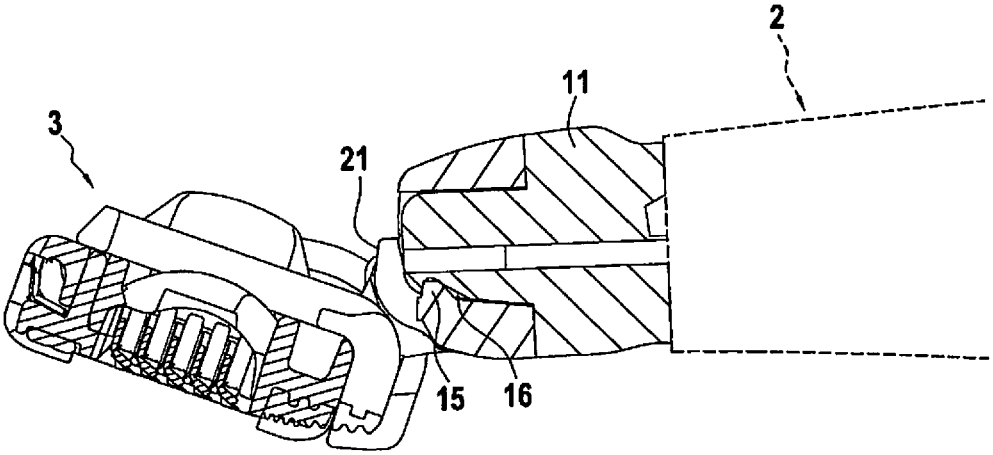
FIG. 6 is a detail cut view of the exchangeable razor blade cartridge and the connector of the blade handle once connected.
Figure 8A:
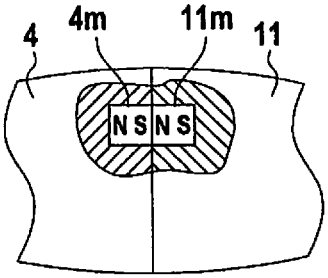
FIGS. 8A and 8B schematically illustrate alternative magnetic and press-fit connections.
Figure 8B:
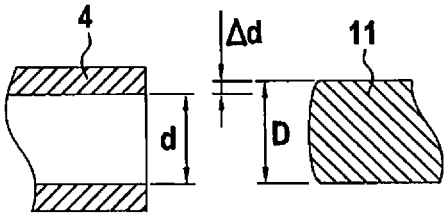

The interconnecting member 4 of the exchangeable razor blade cartridge 3 may be snap-fit onto connector 11 of the actuation assembly 11. As shown in FIGS. 5 and 6, the interconnecting member 4 may comprise protruding lips 15. Protruding lips 15 snap-fit into corresponding undercuts 16 formed in the connector 19, thereby facilitating the snap-fit connection of the connector 11 into the interconnecting member 4. Following the snap-fit connection, latching surfaces 15*a* on the protruding lips 15 of the interconnecting member 4 engage opposite surfaces 16*a* of the undercuts 16 of connector 11 to prevent separation of exchangeable razor blade cartridge 3 from razor handle 2. Although in FIGS. 5 and 6 the connection is thus shown as a snap-fit connection, alternatives may instead be considered, such as, for instance, a magnetic connection or a press-fit connection. FIG. 8A schematically illustrates a magnetic connection which may comprise magnets 4*m* and 11*m* on, respectively, interconnecting member 4 and connector 11. The magnets 4*m* and 11*m* may be oriented with opposite-sign poles facing each other so as to attract the interconnecting member 4 to the connector 11. FIG. 8B schematically illustrates a press-fit connection which may have an interference Δd between a dimension d of interconnecting member 4 and a corresponding dimension D of connector 11, so as to create pressure and thus friction between opposite surfaces of interconnecting member 4 and connector 11 to maintain the connection between interconnecting member 4 and connector 11.

The release mechanism 18 of the actuation assembly 11 may be configured to facilitate release of the exchangeable razor blade cartridge 3 from the razor handle 2. According to further aspects, the release mechanism 18 may be, a fork-shaped ejector, comprising two front prongs 18*a* extending from and spaced by a central block 18*b*. The pusher 9 may be positioned between the two front prongs 18*a* of the release mechanism 18. The pusher spring 20 may be interposed between the pusher 9 and the central body 13.

According to further aspects, the interconnecting member 4 may comprise ears 21 adjacent to the protruding lips 15. Upon assembly, the pusher 9 and the two front prongs 18*a* of the release mechanism 18 may be received within the connector 11, which may be open at front and rear parts 11*a*, 11*b*. The two front prongs 18*a* may be aligned with respective ears 21 of the interconnecting member 4 of exchangeable razor blade cartridge 3 thereby facilitating disconnection of the connector 11 and razor handle 2 with the interconnecting member 4 of the exchangeable razor blade cartridge 3.

Figure 9:
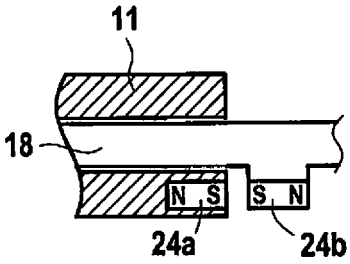
FIG. 9 is a schematic drawing of an alternative return mechanism for the razor of FIG. 1.

According to further aspects, the central block 18*b* of the release mechanism 18 may comprise at least one and in particular two pairs of oppositely inclined cam surfaces 35, although higher numbers of pairs can also be considered. The oppositely inclined cam surfaces 35 may be disposed at an end opposite to the two front prongs 18*a* of the release mechanism 18 and each pair may form one V-shaped concavity. The rear part 23 may comprise a pair of pins forwardly protruding therefrom. Each V-shaped concavity may be configured to receive a respective pin 34 protruding forwardly from the rear part 23. The release mechanism 18 may comprise a shaft 32 protruding from the back thereof. The shaft 32, protruding from the back of release mechanism 18 may be received within a central orifice 33 formed in rear part 23, between the two pins 34 of rear part 23. The oppositely inclined cam surfaces 35 and pins 34 form a cam mechanism 36 for converting rotation of the rear part 23, relative to the connector 11, clockwise and/or counter-clockwise from a central position and about the longitudinal axis Y, into a forward longitudinal and linear motion of the release mechanism 18. The razor handle 2 may further comprise a return mechanism 24, which may for instance be shaped as a spring interposed between the central body 13 and the central block 18*b* of the release mechanism 18 so as to urge the release mechanism 18 backwards and the rear part 23, through cam mechanism 36, which may be reversible, back into the central position. Although the return force may be provided elastically, as illustrated in FIGS. 3 and 4, in further aspects it may be provided by alternative means, for instance magnetically, as illustrated in FIG. 9. As shown there, instead of springs, the return mechanism 24 may comprise magnets 24*a* and 24*b* oriented so that same-sign poles face each other so as to repel each other and interposed between connector 11 and release mechanism 18 so as to provide this magnetic return force.

According to further aspects, the exchangeable razor blade cartridge 3 may be connected to the razor handle 2 by inserting connector 11 into interconnecting member 4 as shown in FIG. 4, until protruding lips 15 of interconnecting member 4 snap into undercuts 16 of connector 11, as shown in FIG. 5. Engagement of latching surfaces 15*a* on the protruding lips 15 of the interconnecting member 4 against opposite surfaces 16*a* of the undercuts 16 of connector 11 then prevents axial separation of the connector 11 from interconnecting member 4 in the direction of longitudinal axis Y. Cooperating non-round cross-sectional shapes of the connector 11 and interconnecting member 4 may also prevent relative rotation of the connector 11 and interconnecting member 4 once joined by this snap-fit connection.

Figure 7A:
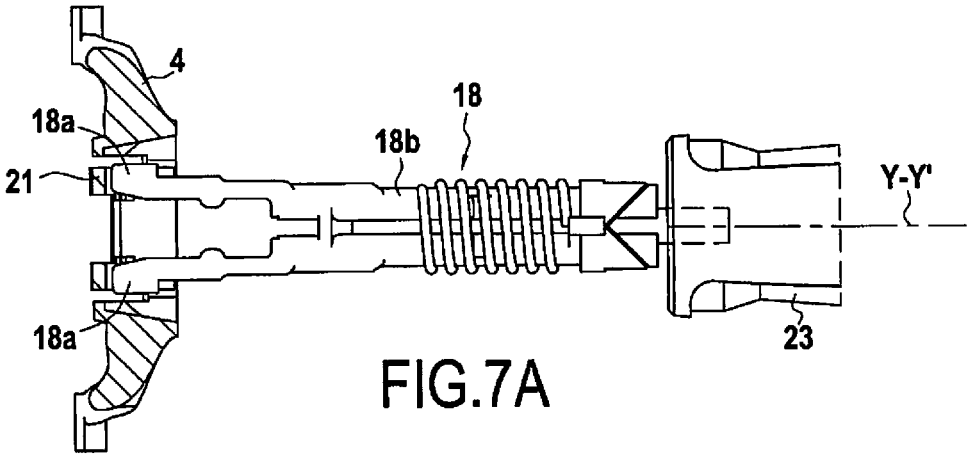
FIG. 7A is a detail view of the release mechanism at a first position before release of the exchangeable razor blade cartridge from the razor handle.
Figure 7B:
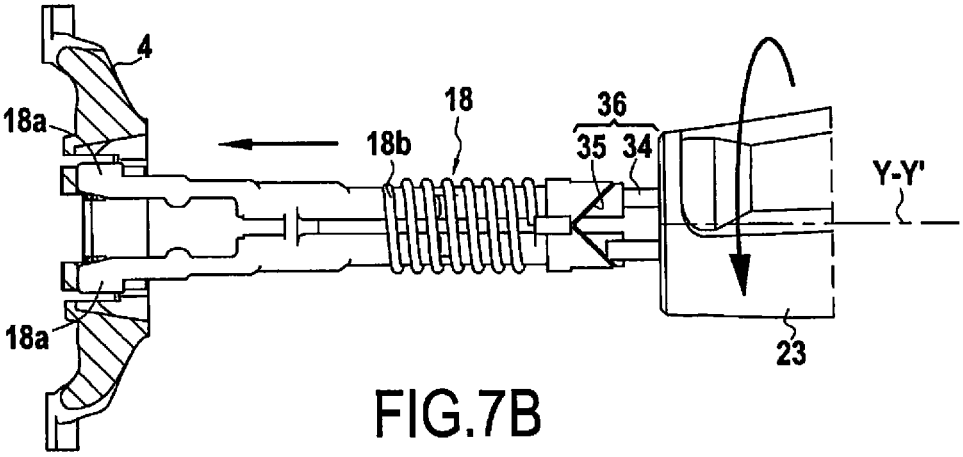
FIGS. 7B and 7C are detail views of the release mechanism at second and third positions when releasing the exchangeable razor blade cartridge from the razor handle by turning the release trigger in each direction around a longitudinal axis.
Figure 7C:
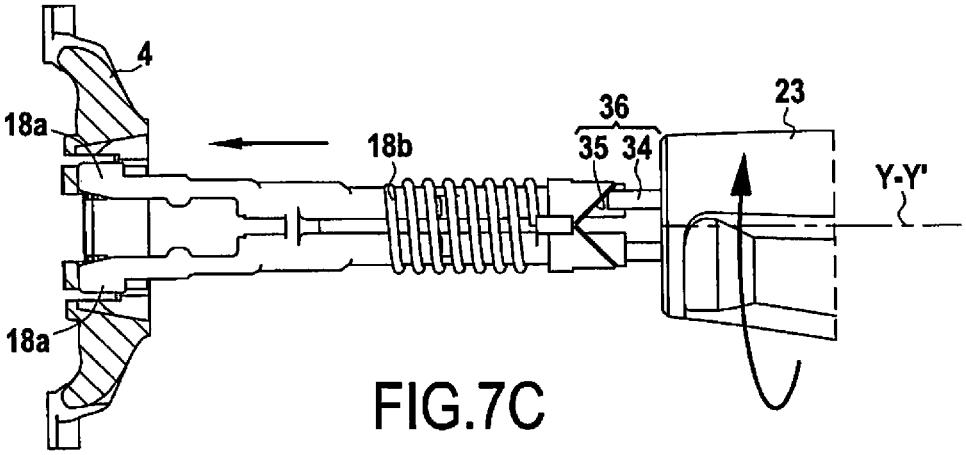

To then trigger the release of exchangeable razor blade cartridge 3 from razor handle 2, rear part 23 may be twisted either way, clockwise and/or counter-clockwise from the starting position as shown on FIG. 7A, about the longitudinal axis Y, relative to central body 13 and connector 11, pushing forward the release mechanism 18 through the cam mechanism converting the twisting motion of rear part 23 into a forward motion of release mechanism 18. As such, pins 34 of the rear part 23 may abut against respective cam surfaces 35 at the rear of central block 18*b* of release mechanism 18. Engagement of the pins 34 with the cam surfaces 35 may actuate the longitudinal and linear motion of the release mechanism 18. As the release mechanism 18 moves forward against return mechanism 24, the two front prongs 18*a* may push against ears 21 of the interconnecting member 4, as shown on FIGS. 7B and 7C. With the interconnecting member 4 still retained by the engagement of latching surfaces 15*a* on the protruding lips 15 of the interconnecting member 4 against opposite surfaces 16*a* of the undercuts 16 of connector 11, a force may be exerted by the front prongs 18*a* on ears 21 of the interconnecting member 4. The force imparted on the ears 21 will induce a bending stress in the interconnecting member 4 that will deflect the latching surfaces 15*a* until they snap out of engagement with the opposite surfaces 16*a* on the undercuts 16 of connector 11, thus releasing the interconnecting member 4 from connector 11. A further push of the two front prongs 18*a* against ears 21 may impart a force upon the pusher-spring 20 and pusher 9 to separate the exchangeable razor blade cartridge 3 from razor handle 2. After the user stops twisting the rear part 23 with respect to the central part 13 and connector 11, return mechanism 24 may push back release mechanism 18 so as to return release mechanism 18 towards the starting position. This returning movement of release mechanism 18 may in turn, through cam mechanism 36, which may be reversible, also return rear part 23 towards the starting position.

Further aspects may comprise that, apart from the razor blades 8 and springs, which are usually metallic, a majority of the parts of the razor 1 may be produced from organic polymeric material. Additional aspects may comprise injection molding techniques such as co-injection. Co-injection techniques may be used to produce parts with multiple colors and/or textures. For example, the razor handle 2 may comprise an elastomer for providing a good grip, co-injected on a more rigid thermoplastic polymer providing structural integrity. However, alternatively or complementarily to organic polymeric materials, other materials, such as for instance metal, glass or wood, and in particular moldable materials, may be used. Higher-density materials may for instance be used within the razor handle 2 in order to locate the center of gravity of the razor 1 at an ergonomically optimal location.

Figure 10A:
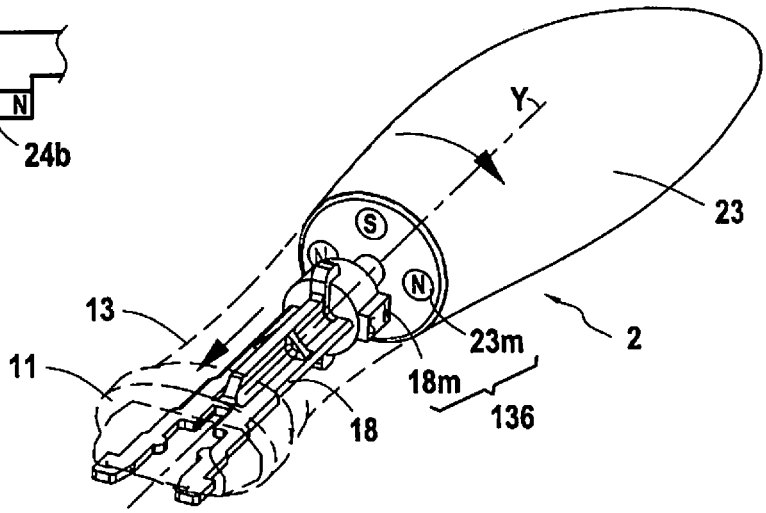
FIGS. 10A and 10B are schematic views of a razor according to another aspect of the disclosure, with the release trigger in two different positions.
Figure 10B:
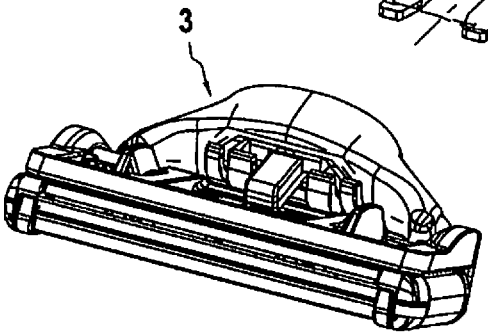
Figure 10B:
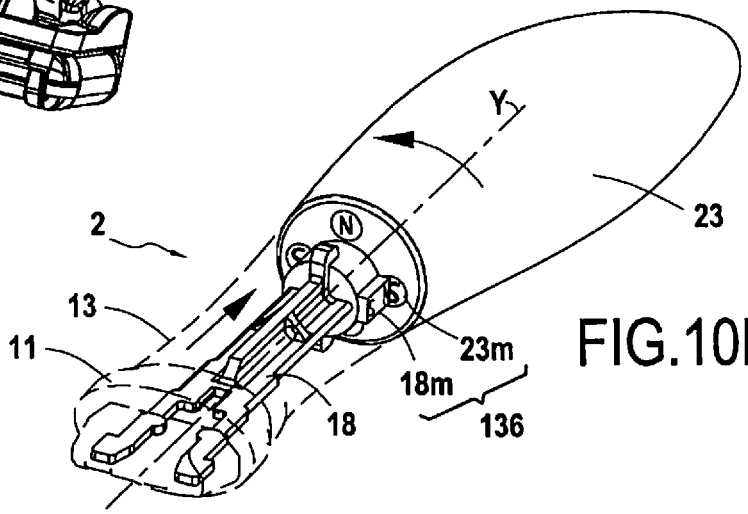

Furthermore, it is also possible to replace the cam mechanism 36 with alternative means, such as for example a magnetic mechanism, to convert the rotation of the release trigger into a longitudinal movement of the release mechanism. Such an alternative magnetic mechanism 136, replacing both the cam mechanism 36 and the return mechanism 24, is schematically illustrated in FIGS. 10A and 10B. As shown in this schematic drawing, release mechanism 18 may be glidingly held within the razor handle 2, so as to move only along longitudinal axis Y with respect to the connector 11 at the front of the razor handle 2, as in the previous aspects, and further comprise, instead of inclined cam surfaces, at least one magnet 18*m*, laterally offset and parallel with respect to longitudinal axis Y. Release mechanism 18 may further be backstopped within the razor handle 2, to limit its forward gliding movement along longitudinal axis Y. Opposite to this magnet 18*m*, the rear part 23 of the razor handle 2 may, as in the previous aspects, be configured as a release trigger rotatable about longitudinal axis Y with respect to the connector 11. The rear part 23, as a release trigger, may further comprise a plurality of magnets 23*m* arranged with alternating polarities in a circumference around longitudinal axis Y, adjacently and oppositely to magnet 18*m* of the release mechanism 18.

In operation, as the user rotates the release trigger, that is, rear part 23, around the longitudinal axis Y, the magnet 18*m* on release mechanism 18 will alternatively repel and be attracted to magnets 23*m* on the rear part 23. When this rotation opposes a rear pole of magnet 18*m* to a front pole, of a magnet 23*m*, with the same sign, the magnetic repulsion force between the opposing magnets may actuate the release mechanism 18, moving it forward to release the exchangeable blade cartridge 3 from the connector 11 at the front of the razor handle 2, as shown in FIG. 10A. If the user stops twisting the release trigger, that is, rear part 23, with respect to the connector 11, magnetic repulsion between same-sign magnetic poles on magnets 18*m* and 23*m* and magnetic attraction between opposite-sign magnetic poles on magnets 18*m* and 23*m* may automatically return both the release mechanism 18 and rear part 23 towards a starting position, as shown in FIG. 10B, in which release mechanism 18 is held back by attraction of the rear pole of magnet 18*m* to an opposite-sign pole of one of the magnets 23*m* on rear part 23.

Those skilled in the art will recognize that the present disclosure may be manifested in a variety of forms other than the specific aspects described and contemplated herein. Accordingly, departure in form and detail may be made without departing from the scope of the present disclosure as described in the appended claims.

The invention claimed is:

1. A method for releasing an exchangeable razor blade cartridge from a razor handle, the method comprising:

rotating a release trigger extending along a longitudinal axis of the razor handle about the longitudinal axis of the razor handle, wherein the release trigger is configured to rotate about the longitudinal axis of the razor handle relative to a connector to push a rear end of a release mechanism to impart a force through the release mechanism to the exchangeable razor blade cartridge to release the exchangeable razor blade cartridge from the razor handle so that the exchangeable razor blade cartridge is separated from the connector of the razor handle by the rotation of the release trigger.

2. A razor handle comprising:

a body extending along a longitudinal axis of the razor handle, the body including a front end and a rear end;

a connector including a front end configured to couple to an exchangeable razor blade cartridge, and a rear end connecting to the front end of the body;

a release mechanism including a front end and a rear end, and extending through the body and into the connector, wherein the front end of the release mechanism is configured to contact the exchangeable razor blade cartridge; and a release trigger extending along the longitudinal axis of the razor handle and rotatable relative to the rear end of the body, wherein the release trigger is configured to rotate about the longitudinal axis of the razor handle relative to the body and the connector to push the rear end of the release mechanism to impart a force through the release mechanism to the exchangeable razor blade cartridge to separate the exchangeable razor blade cartridge from the connector of the razor handle.

3. The razor handle according to claim 1, wherein the release trigger being a rear end of the razor handle and the front end of the connector being located at a front end of the razor handle.

4. The razor handle according to claim 1, further including a cam mechanism configured to convert the rotation of the release trigger about the longitudinal axis of the razor handle into a linear motion along the longitudinal axis to push the rear end of the release mechanism.

5. The razor handle according to claim 4, wherein the cam mechanism includes first and second cam surfaces inclined in opposite directions, the first and second cam surfaces being operable to convert the rotation of the release trigger in opposite rotational directions into the linear motion along the longitudinal axis to push the rear end of the release mechanism.

6. The razor handle according to claim 5, wherein:

the release trigger includes a first pin and a second pin extending forward from the front end of the release trigger; and rotation of the release trigger causes the first pin to engage the first or second cam surface, and causes the second pin to engage the other of the first or second cam surface, to push the release mechanism away from the release trigger and toward the razor blade cartridge.

7. The razor handle according to claim 4, wherein the release mechanism is configured to deflect a latching surface of the exchangeable razor blade cartridge in response to the rotation of the release trigger.

8. The razor handle according to claim 7, further including a spring-loaded pusher disposed at the front end of the body.

9. The razor handle according to claim 8, wherein the release mechanism includes a fork-shaped ejector having two front prongs at the front end of the release mechanism, wherein the two front prongs are configured to contact the exchangeable razor blade cartridge, and the spring-loaded pusher is located between the two front prongs.

10. A razor comprising:

the razor handle according to claim 2, and the exchangeable razor blade cartridge connected to the front end of the connector of the razor handle.

11. The razor according to claim 10, wherein the exchangeable razor blade cartridge includes:

a head extending along a longitudinal axis perpendicular to the longitudinal axis of the razor handle when the exchangeable razor blade cartridge is connected to the razor handle, and pivotable about the longitudinal axis of the head when the exchangeable razor blade cartridge is connected to the razor handle, at least one razor blade provided in the head and extending along an axis parallel to the longitudinal axis of the head, and an interconnecting member including a front end connected to the head and a rear end configured to be connected to the front end of the connector of the razor handle.

12. The razor according to claim 11, wherein the rear end of the interconnecting member of the exchangeable razor blade cartridge is configured to be snap-fitted to the front end of the connector of the razor handle.

13. The razor handle according to claim 2, wherein the release trigger is a rearmost portion of the razor handle.

14. The razor handle according to claim 2, further comprising:

a return mechanism, wherein:

a first rotation of the release trigger from a central position in either a first rotational direction or a second rotational direction, opposite to the first rotational direction, causes the release mechanism to move away from the release trigger, and the return mechanism is configured to cause the release mechanism to move toward the release trigger and rotate the release trigger back to the central position.

15. The razor according to claim 12, wherein the interconnecting member includes two latching surfaces, and the connector includes two undercuts, wherein each of the two latching surfaces snaps into one of the two undercuts of the connector when the razor blade cartridge is attached to the razor handle.

16. The razor according to claim 15, wherein the razor blade cartridge includes two ears;

the release mechanism includes two front prongs at the front end of the release mechanism, wherein each of the two front prongs is configured to contact one of the ears of the razor blade cartridge; and forward movement of the release mechanism after rotation of the release trigger causes each of the two front prongs to push against respective ears to induce a bending stress in the razor blade cartridge that causes the two latching surfaces of the razor blade cartridge to snap out of respective undercuts of the connector, releasing the interconnecting member from the connector.

17. The razor according to claim 16, further including a spring loaded pusher at the front end of the body, wherein the forward movement of the release mechanism also imparts a force on the spring loaded pusher that separates the razor blade cartridge from the razor handle.

18. The razor according to claim 17, wherein:

the release trigger includes a first pin and a second pin extending forward from the front end of the release trigger;

the razor handle further includes a cam mechanism configured to convert the rotation of the release trigger about the longitudinal axis of the razor handle into a linear motion along the longitudinal axis to push the rear end of the release mechanism;

the cam mechanism includes first and second cam surfaces inclined in opposite directions, the first and second cam surfaces being operable to convert the rotation of the release trigger in opposite rotational directions into the linear motion along the longitudinal axis to push the rear end of the release mechanism; and rotation of the release trigger causes the first pin to engage the first or second cam surface, and causes the second pin to engage the other of the first or second cam surface, to push the release mechanism away from the release trigger and toward the razor blade cartridge.

19. The razor according to claim 18, further comprising:

a return spring disposed between the body and the release mechanism, wherein forward movement of the release mechanism compresses the return spring, wherein an absence of a rotational force acting on the release trigger, after compression of the return spring, causes the return spring to expand and move the release mechanism rearward toward the release trigger, and rotate the release trigger back to a resting position.

* * * * *